United States Patent [19]

Harry et al.

[11] Patent Number: 5,066,379

[45] Date of Patent: Nov. 19, 1991

[54] CONTAINER FOR CORROSIVE MATERIAL

[75] Inventors: John O. Harry; George Verhagen, both of Green Bay, Wis.; Rudy E. Small, Naples, Fla.

[73] Assignee: Corrosion Technology, Inc., Green Bay, Wis.

[21] Appl. No.: 538,179

[22] Filed: Jun. 14, 1990

[51] Int. Cl.[5] ..... C25C 7/00; C25D 17/02

[52] U.S. Cl. ..... 204/279; 206/524.5; 220/676; 220/DIG. 6

[58] Field of Search ..... 204/279, 242; 206/524.5; 220/DIG. 6, 676; 428/35.7

[56] References Cited

U.S. PATENT DOCUMENTS

| | | | |
|---|---|---|---|
| 2,816,070 | 12/1957 | Buchanan | 204/279 |
| 3,401,109 | 9/1968 | Anderson | 204/242 |
| 3,403,091 | 9/1968 | Currey et al. | 204/242 |
| 3,409,536 | 11/1968 | Barber et al. | 204/242 |
| 3,679,568 | 7/1972 | Westerlund | 204/279 |
| 3,682,809 | 8/1972 | Marquardson et al. | 204/275 |
| 3,763,083 | 10/1973 | Grotheer | 204/279 X |
| 3,764,083 | 10/1973 | Grotheer | 204/279 |
| 3,920,603 | 11/1975 | Stayner et al. | 260/40 R |
| 3,959,110 | 5/1976 | Burgess | 204/275 X |
| 4,213,842 | 7/1980 | Dufresne | 204/279 |
| 4,621,010 | 11/1986 | Wadsworth | 428/220 |
| 4,885,071 | 12/1989 | Harry et al. | 204/279 |
| 4,885,072 | 12/1989 | Harry et al. | 204/279 |

FOREIGN PATENT DOCUMENTS

| | | |
|---|---|---|
| 0170740 | 7/1960 | European Pat. Off. . |
| 1006153 | 4/1957 | Fed. Rep. of Germany . |
| 2058335 | 7/1971 | Fed. Rep. of Germany . |
| 1177974 | 4/1959 | France . |

OTHER PUBLICATIONS

High Quality EFCO Form Produces Complicated Concrete Structures in Form Marks, Spring/Summer 1982, Intercompany Telex of AT&T Nassau Metals, S. Carouna, U.S.A.

Electrolytic Cells as Cominco's Lead and ZInc Operations-Report.

*Primary Examiner*—Donald R. Valentine

*Attorney, Agent, or Firm*—Michael, Best & Friedrich

[57] ABSTRACT

A container formed of polymer concrete in which minerals such as copper are purified in an electrolytic process. The container icludes a bottom and end and side walls for containing a corrosive electrolyte, such as, a sulphuric or hydrochloric acid solution. An overflow box is integrally formed in a first formation extending vertically along one end wall of the cell and an overflow pipe is molded into the first formation and extends from the overflow box outwardly of the cell. A vertical covered inlet chanel or cast-in pipe is provided at the opposite end of the container and extends from its upper to its lower end.

25 Claims, 2 Drawing Sheets

CONTAINER FOR CORROSIVE MATERIAL

BACKGROUND OF THE INVENTION

This invention relates to containers for highly corrosive solutions and more particularly to containers for use in the electrolytic refinement or electrowinning of metals such as copper.

In one type of process for the refinement of metals such as copper, a substantially pure copper anode is immersed in a suitable electrolyte, such as, a hydrochloric or sulphuric acid solution. The copper is deposited in a pure form on a cathode when an electric current is passed between the electrodes.

One type of prior art container employed for such electrolytic cells consists of an open concrete shell having end and side walls and a bottom. Spent electrolyte in the cell is replaced by introducing fresh electrolyte at one end of the cell and beneath the electrolyte's surface. At the opposite end of the cell, the spent electrolyte flows into an overflow box from which it is drained by an overflow pipe. Fresh electrolyte is normally fed into the cell at temperatures of about 140°-160° F., while the spent electrolyte in the cell will normally be at a lower temperature. It is important to withdraw the colder, spent electrolyte since it tends to solidify at about 120° F.

Prior art cells were not wholly satisfactory because either the method of introducing electrolyte did not insure even distribution of fresh electrolyte along the bottom of the vessel or easily damaged piping was employed. Prior art vessels were also unsatisfactory because the overflow and decanting pipes were susceptible to physical damage, particularly during loading or unloading of cells with anodes and cathodes.

SUMMARY OF THE INVENTION

It is an object of the invention to provide a new and improved container for electrolytic materials.

Another object of the invention is to provide containers for electrolytic materials and having improved decanting, overflow, and feed piping.

A further object of the invention is to provide an electrolytic cell feed system which provides more uniform distribution of electrolyte along the lower surface of the cell.

A still further object of the invention is to provide an electrolytic cell wherein the inlet, overflow, and decanting piping is less subject to damage.

These and other objects and advantages of the present invention will become more apparent from the detailed description thereof taken with the accompanying drawings.

According to one of its aspects, the invention comprises a container for corrosive electrolyte used in an electrolytic process and consisting of a cured polymer concrete shell having a pair of side walls, a pair of opposed end walls, and a bottom. An overflow box is formed in one end wall and includes a recess formed below the upper edge of the one end wall and conduit means having one end opening in the recess and the other end opening exteriorally of the vessel. A passage is provided in the second end wall and extending from the upper end of the wall downwardly to a position adjacent its lower end for defining a vertical passage along the inner surface of the other end wall and which is open at its upper end and adjacent the bottom wall of the cell.

According to another of its aspects, the invention comprises a container for corrosive electrolyte used in an electrolytic process and consisting of a cured polymer concrete shell having side walls, a pair of opposed end walls, and a bottom. Each of the end walls has inner and outer surfaces. A formation is molded on the outer of one end wall and extending from its upper and lower ends and intermediate the sides thereof and a recess is formed in the upper end of the formation and opening toward the inner surface of the end wall and below the upper edge thereof. A discharge passage is formed in the formation and spaced from the outer surface of the formation and the inner surface of the end wall. The discharge passage has a first end opening in the recess and a second end opening at the lower end of the formation. According to another aspect of the invention, a second passage is formed in the formation and extends generally horizontally from the inner surface of the end wall to the discharge passage.

DETAILED DESCRIPTION OF THE PREFERRED EMBODIMENT

Figures 1, 2, 3, 4, 5, 6, 7:
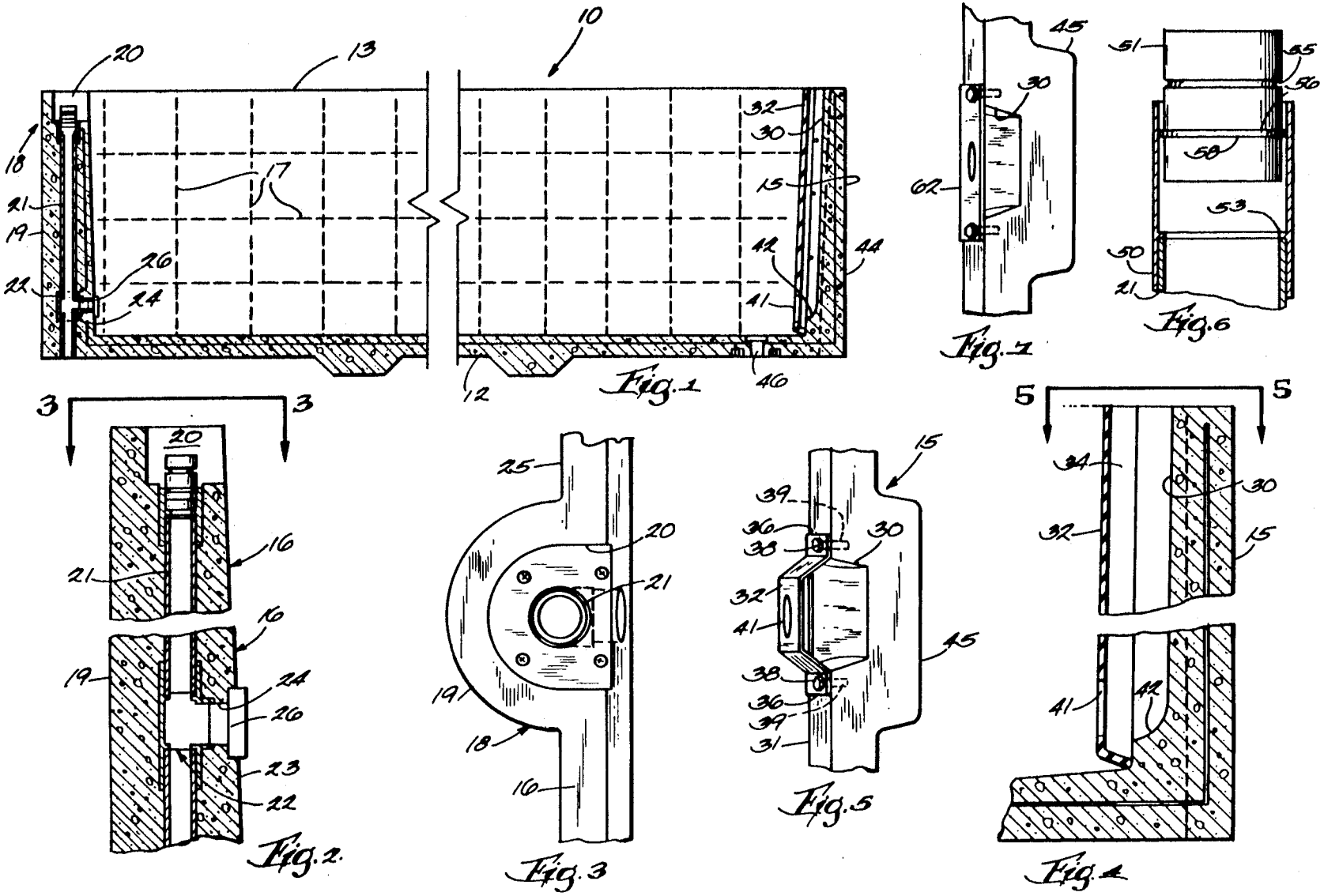
FIG. 1 is a side elevational view, partly in section, showing a cell according to the present invention.
FIG. 2 is an enlarged fragmentary cross-sectional view of one end of the cell illustrated in FIG. 1.
FIG. 3 is a view taken along lines 3—3 of FIG. 2.
FIG. 4 is an enlarged fragmentary cross-sectional view showing the other end of the cell illustrated in FIG. 1.
FIG. 5 is a view taken along lines 5—5 of FIG. 4.
FIG. 6 is an enlarged fragmentary view of a portion of the overflow box shown in FIGS. 2 and 3.
FIG. 7 illustrates an alternate embodiment of the invention.

A cell 10 according to the preferred embodiment of the invention is shown in the drawings to include a bottom 12, side wall 13, and end walls 15 and 16, only one side wall being seen in FIG. 1. The cell may be formed of any suitable material such as the polymer concrete disclosed in U.S. Pat. No. 4,885,072. The inner and outer surfaces of the cell may be coated with a corrosion-resistant lining. A matrix of reinforcing bars 17 of a nonconductive material, such as FRP fiberglass, is disposed in the bottom 12 and extends up the side and end walls 13, 15 and 16 as reinforcement against damage.

An overflow box 18 is provided in a semi-cylindrical formation 19 integrally molded on the outer surface 25 of end wall 16 and intermediate its ends and extending from its top to its bottom. The overflow box 18 is defined by a recess 20 formed in the inner portion of formation 19 and opening into the interior of the cell 10 and extending downwardly from its upper periphery. At the center of the formation 19 an overflow pipe 21 is cast and extends vertically from the recess 20 downwardly through the lower end of formation 19 and is open at its opposite ends. Spaced upwardly from the lower end of pipe 21, there is a T-joint 22 which opens into an opening 24 extending between the T-joint 22 and the inner surface 23 of wall 16. As a result, the interior of the cell 10 communicates with the overflow pipe 21 at a point spaced above the lower end of the cell. Normally, when the cell is full, a plug 26 is disposed within opening 24.

At the opposite end of the cell 10, there is a shallow inlet channel 30 formed in the inner surface 31 of the end wall 15 and extending from its upper end to a point spaced above the lower end of cell 10. A channel-shaped duct member 32 is suitably fixed over channel 30 to define a closed, hollow passage 34 therewith. In particular, channel member 32 has a flange 36 affixed to each side and extending along its length. The flanges 36 are fixed to the inner surface 31 of end wall 15 in any suitable manner such as bolts 38 which extend through openings in flanges 36 and are received in a plurality of metallic inserts 39 having internally threaded openings and molded into wall 15 in spaced apart relation along the sides of channel 30. Channel cover 32 extends from the upper to the lower ends of wall 15 and there is an opening 41 at its lower end which corresponds to the arcuate surface 42 at the lower end of channel 30. On the outer surface 44 of end wall 15 in the area of the channel 30, there is a formation 45 so that the channel 30 does not reduce the overall wall thickness.

When fresh electrolyte is being fed into the cell 10, it flows downwardly along channel 30 and between the surface of the channel and cover 32 and outwardly through the opening 41 for distribution at the bottom of the cell 10. This causes the spent, cooler electrolyte in the cell to rise and flow into overflow box 18 and downwardly through discharge pipe 21 where it is suitably collected. To decant the cell 10, the plug 26 is removed to permit the electrolyte to drain through the decant opening 24 which is above the level that sludge would normally collect. Such sludge may then be drained through a normally plugged drain hole 46. The bottom 12 of the cell may be sloped from one side and one end or both sides and one end to facilitate the removal of sludge.

The integral overflow box 18, discharge pipe 21, and decanting passage 24 according to the invention along with the inlet channel 30 and cover 32 eliminate exposed piping employed in prior art cells, and thereby substantially minimizes damage and maintenance expense.

As seen in FIG. 6, the height of the upper end of pipe 20 may be extended by means of a fitting 50 and an extension pipe 51. The fitting 50 is telescoped over the end of pipe 21 and has an integral flange 53 on its inner surface which engages the upper peripheral edge of pipe 21. Extension pipe 51 has a pair of spaced apart peripheral grooves 55 and 56 in its outer surface for receiving a ring 58. Depending upon the added height desired, ring 58 will be disposed in either the lower or upper grooves. After ring 58 has been positioned, it is force fit into fitting 50 so as to fix the extension 51 in position and to seal its outer periphery. It will be appreciated that if a lower height is desired, ring 58 will be positioned in the upper groove 55. In addition, if greater height is desired, the upper portion of pipe 51 can be extended.

FIG. 7 shows an alternate embodiment of the cover for channel 30. In particular, cover 62 is relatively plainer so that it does not protrude into the interior of the cell.

Figure 8:
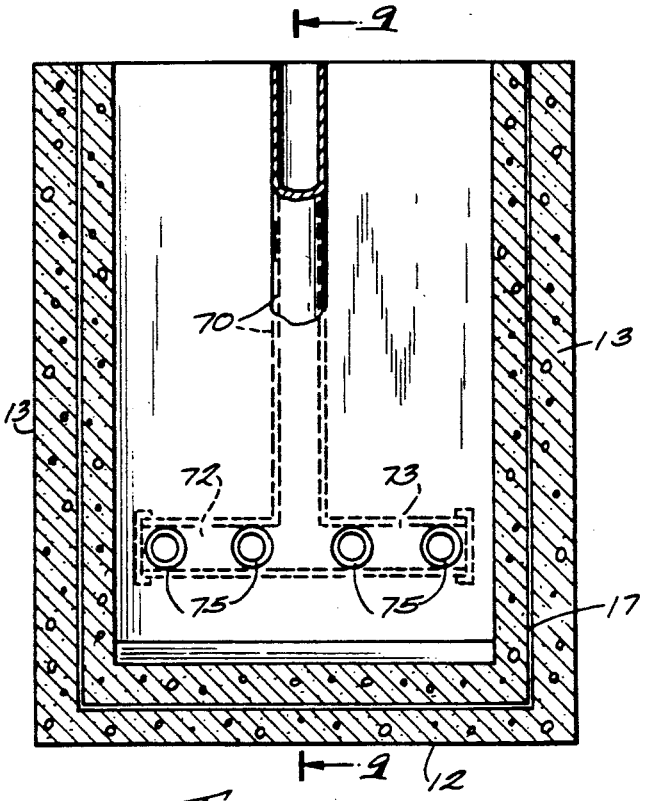
FIG. 8 shows an alternate embodiment of the invention.
Figure 9:
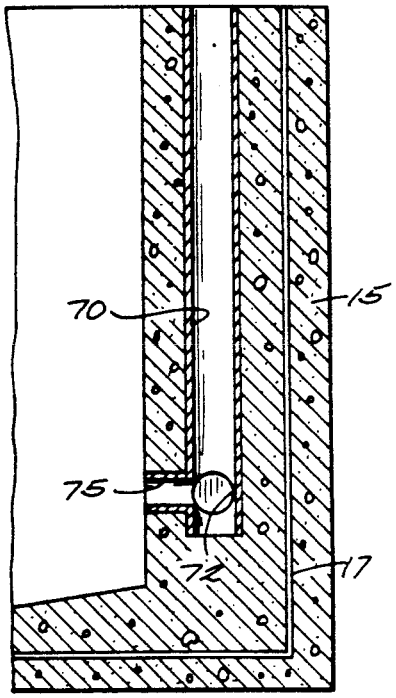
FIG. 9 is a view taken along lines 9—9 of FIG. 8.

FIGS. 8 and 9 show an alternate embodiment of the invention wherein the inlet passage is cast into the end wall 15. In particular, the inlet channel is formed of a pipe 70 cast into wall 15 and having manifold pipes 72 and 73 extending laterally from its lower end and in general parallelism with wall 15. Each manifold pipe 72 and 73 has a plurality of laterally spaced apart pipe sections 75 extending in a direction parallel to the bottom 12 and opening into the cell 10. This provides a more even distribution of fresh electrolyte along the bottom 12 of the cell than can be achieved with the embodiment of FIGS. 1–7. While two pipe sections 75 are illustrated, it will be appreciated that any suitable number or size may be employed without deviating from the invention. Preferably, the diameters of the pipes 75 are greater than that of the pipes 73 as shown in FIGS. 8 and 9.

Figure 10:
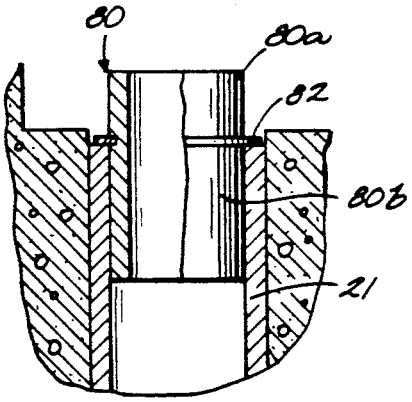
FIGS. 10 and 11 show an alternate embodiment of the invention.
Figure 11:
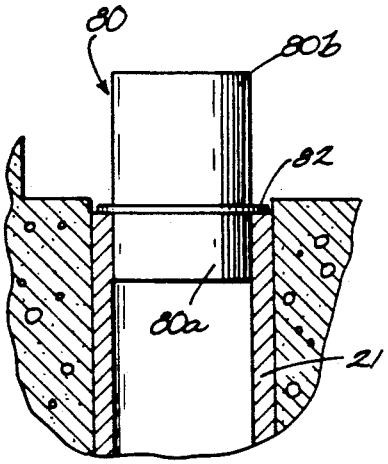

Another embodiment of the overflow pipe extension is shown in FIGS. 10 and 11 to include a cylindrical member 80 which is telescopingly received within overflow pipe 21. A flange 82 extends outwardly from member 80 to divide member 80 into a first portion **80*a* and a second portion 80*b*. It can be seen in FIGS. 9 and 10 that the flange 82 has a diameter greater than that of the pipe 21 and is closer to one end of the adapter 80 than the other so that the portion 80*b* is longer than the portion 80*a*. As a result, if the portion 80*b* of member 80 is inserted into pipe 21, the upper end of the extension will be at a first height while if portion 80*a* is disposed within the pipe 21**, the upper end of the extension will have a second, higher elevation. In this manner, the upper end of the overflow pipe can be conveniently adjusted.

While only a few embodiments of the invention have been illustrated and described, other equivalent embodiments will become apparent to those skilled in the art. Accordingly, it is not intended to limit the invention to the disclosed embodiment, but only by the scope of the appended claims.

What is claimed is:

1. A container for corrosive electrolyte and used in an electrolytic process, said container consisting of a cured polymer concrete shell having a pair of side walls, a pair of opposed end walls, and a bottom, the improvement comprising an overflow box formed in one side wall and including a recess formed below the upper edge of the one end wall, and including discharge passage means having one end opening in said recess and the other end opening exteriorally of the vessel, second passage means formed in and beneath the surface of the second end wall and extending from the upper end of said wall downwardly to a position adjacent its lower end, said channel defining a vertical passage in the other end wall, said second passage means being open at its upper end and adjacent the bottom of the container.

2. The container set forth in claim 1 wherein the other end wall has a formation on its outer surface corresponding to said passage and extending from its upper to its lower end so that the passage does not diminish the relative thickness of the end wall at said passage.

3. The container set forth in claim 2 wherein said passage comprises a channel formed in the second end wall and on the inner surface thereof, and cover means disposed over said channel and having an opening adjacent its upper and lower ends, said cover and said channel defining a vertical passage along the inner surface of the outer wall and which is open at its upper end and adjacent the bottom of the container.

4. The container set forth in claim 3 wherein said channel has an arcuate surface at its lower end facing inwardly, the opening adjacent the lower end of said cover being opposed to said arcuate surface, whereby electrolyte delivered to said passage will flow downwardly along said channel and be redirected by said arcuate surface outwardly of said opening for substantially even distribution of the electrolyte along the lower wall of the container.

5. The container set forth in claim 1 wherein said passage is defined by a pipe molded into said second end wall and beneath the surface thereof, said pipe defining a vertical passage within the second end wall and which is open at its upper end and adjacent the bottom of the container.

6. The container set forth in claim 5 wherein means defining multiple openings are provided at the lower end of the pipe for defining a plurality of openings therein spaced apart adjacent the bottom of the cell for defining a plurality of outlets for the lower end of said passage, whereby fresh electrolyte may be dispersed along the bottom of the container.

7. The container set forth in claim 6 wherein said multiple opening means are defined by a pair of manifold pipe means disposed in said second end wall and adjacent the lower end thereof, each of said manifold pipe means having a plurality of spaced apart openings communicating with said container.

8. A container for a corrosive electrolyte and used in an electrolytic process, said container consisting of a cured polymer concrete shell and having side walls, a pair of opposed end walls, and a bottom, each of said end walls having inner and outer surface, a formation molded on the outer surface of one end wall and extending from its upper to its lower ends and intermediate the sides thereof, a recess formed in the upper end of the formation and opening toward the inner surface of said end wall and below the upper edge thereof, discharge passage means formed in said formation and spaced from the outer surface of the formation and the inner surface of the end wall, said discharge means having a first end opening in said recess and a second end opening at the lower end of said formation, a second passage means formed in said formation and extending generally horizontally from the inner surface of the end wall to the discharge passage.

9. The container set forth in claim 8 wherein said discharge passage means is defined by a first pipe embedded in said formation, and said second passage means is formed by a T-connection in said pipe and extending to the inner surface of the end wall.

10. A container for a corrosive electrolyte and used in an electrolytic process, said container consisting of a cured polymer concrete shell and having side walls, a pair of opposed end walls, and a bottom, each of said end walls having inner and outer surface, a formation molded on the outer surface of one end wall and extending from its upper to its lower ends and intermediate the sides thereof, a recess formed in the upper end of the formation and opening toward the inner surface of said end wall and below the upper edge thereof, discharge passage means formed in said formation and spaced from the outer surface of the formation and the inner surface of the end wall, said discharge passage means having a first end opening in said recess and a second end opening at the lower end of said formation, a passage formed in the second end wall and in the inner surface thereof, said passage extending from the upper end of said wall downwardly to a position adjacent its lower end.

11. The container set forth in claim 10 wherein said passage comprises a channel formed in the second end wall and on the inner surface thereof, and cover means disposed over said channel and having an opening adjacent its upper and lower ends, said cover and said channel defining a vertical passage along the inner surface of the outer wall and which is open at its upper end and adjacent the bottom of the container.

12. The container set forth in claim 11 wherein the other end wall has a formation on its outer surface corresponding to said channel and extending from its upper to its lower end so that the channel does not diminish the relative thickness of the end wall at said channel.

13. The container set forth in claim 12 wherein said channel has an arcuate surface at its lower end facing inwardly, the opening adjacent the lower end of said cover being opposed to said arcuate surface, whereby electrolyte delivered to said passage will flow downwardly along said channel and be redirected by said arcuate surface outwardly of said opening for distribution of the electrolyte along the bottom of the container.

14. The container set forth in claim 13 and including a second passage formed in said formation and extending generally horizontally from the inner surface of the end wall to the vertical passage.

15. The container set forth in claim 14 wherein said first passage is defined by a first pipe embedded in said formation, and said second passage is formed by a connection in said pipe and extending to the inner surface of the end wall.

16. The container set forth in claim 10 wherein said passage is defined by a pipe molded into said second end wall and beneath the surface thereof, said pipe defining a vertical passage within the second end wall and which is open at its upper end and adjacent the bottom of the container.

17. The container set forth in claim 16 wherein means defining multiple openings are provided at the lower end of the pipe for defining a plurality of openings therein spaced apart adjacent the bottom of the cell for defining a plurality of outlets for the lower end of said passage, whereby fresh electrolyte may be dispersed along the bottom of the cell.

18. The container set forth in claim 17 wherein said multiple opening means are defined by a pair of manifold pipe means disposed in said second end wall and adjacent the lower end thereof, each of said manifold pipe means having a plurality of spaced apart openings communicating with said container.

19. A container for a corrosive electrolyte and used in an electrolytic process, said container consisting of a cured polymer concrete shell and having side walls, a pair of opposed end walls, and a bottom, each of said end walls having inner and outer surface, a formation molded on the outer surface of one end wall and extending from its upper to its lower ends and intermediate the sides thereof, a recess formed in the upper end of the formation and opening toward the inner surface of said end wall and below the upper edge thereof, discharge passage means formed in said formation and spaced from the outer surface of the formation and the inner surface of the end wall, said discharge means having a first end opening in said recess and a second end opening at the lower end of said formation, and extension means adjustably coupled to the upper end of said discharge passage means for extending said passage means above the level of the recess.

20. The container set forth in claim 19 wherein said discharge passage means comprises pipe means embedded in said formation and extending from its upper to its lower end, said extension means comprising a short pipe section, and ring means surrounding said pipe section for engaging the upper end of said pipe means for supporting said pipe section and sealing the outer periphery thereof, said pipe section extending the length of said pipe means above the recess.

21. A container for a corrosive electrolyte and used in an electrolytic process, said container consisting of a cured polymer concrete shell and having side walls, a pair of opposed end walls, and a bottom, each of said end walls having inner and outer surfaces, a formation molded on the outer surface of one end wall and extending from its upper to its lower ends and intermediate the sides thereof, a recess formed in the upper end of one end wall and opening toward the inner surface of said end wall and below the upper edge thereof, discharge passage means connected at one end to said recess and at its other end exteriorally of said container and spaced from the outer surface of the formation and the inner surface of the end wall, and means defining a second passage on the second end wall and on the inner surface thereof, said passage extending from the upper end of said wall downwardly to a position adjacent its lower end.

22. The container set forth in claim 21 wherein said second passage is defined by the inner wall surface and means defining a cover for said passage, said passage cover defining means being fixed to the inner surface of the second end wall and having openings at its upper and lower end.

23. A container for a corrosive electrolyte and used in an electrolytic process, said container consisting of a cured polymer concrete shell and having side walls, a pair of opposed end walls, and a bottom, each of said end walls having inner and outer surface, a formation molded on the outer surface of one end wall and extending from its upper to its lower ends and intermediate the sides thereof, a recess formed in the upper end of the formation and opening toward the inner surface of said end wall and below the upper edge thereof, discharge passage means formed in said formation and spaced from the outer surface thereof and the inner surface of the end wall, said discharge passage means having a first end opening in the recess and a second end opening at the lower end of said formation, and including a passage on the second end wall and the inner surface thereof, said passage extending from the upper end of said end wall downwardly to a position adjacent its lower end.

24. The container set forth in claim 23 wherein said passage means is defined by the inner surface of the second end wall and cover means fixed to said end wall and having an opening adjacent its upper and lower ends, said cover and said end walls defining a passage extending along said end wall and on the inner surface thereof and from its upper to its lower end.

25. A container for a corrosive electrolyte used in an electrolytic process, said container consisting of a cured polymer concrete shell and having side walls, a pair of opposed end walls, and a bottom, each of said end walls having inner and outer surfaces, one end wall including a recess is formed in the upper end thereof and opening toward the inner surface of said end wall and below the upper edge thereof, a first, generally vertical discharge passage formed in said end wall and enclosed thereby and spaced from the outer surface of the end wall, the discharge passage having a first end opening in the recess and a second end opening adjacent the lower end of the end wall for draining electrolyte from the upper portion of the container, and a second, generally horizontal discharge passage formed in the end wall and extending from the inner surface of the end wall adjacent a lower portion thereof to the first passage for draining electrolyte from a lower portion of the container whereby electrolyte may be removed from the upper and lower portions of the container.

* * * * *